US007399132B2

(12) United States Patent
Lee

(10) Patent No.: US 7,399,132 B2
(45) Date of Patent: Jul. 15, 2008

(54) DIGITAL TEXTILE PRINTER

(75) Inventor: Gil Hun Lee, Seoul (KR)

(73) Assignee: Taeil Systems Co., Ltd., Seoul (KR)

( * ) Notice: Subject to any disclaimer, the term of this patent is extended or adjusted under 35 U.S.C. 154(b) by 422 days.

(21) Appl. No.: 10/524,150

(22) PCT Filed: Aug. 18, 2004

(86) PCT No.: PCT/KR2004/002061

§ 371 (c)(1),
(2), (4) Date: May 26, 2005

(87) PCT Pub. No.: WO2005/016652

PCT Pub. Date: Feb. 24, 2005

(65) Prior Publication Data

US 2006/0150840 A1 Jul. 13, 2006

(30) Foreign Application Priority Data

Aug. 19, 2003 (KR) ..... 10-2003-0057321

(51) Int. Cl.
*B41J 15/00* (2006.01)

(52) U.S. Cl. ..... 400/618; 400/619

(58) Field of Classification Search ..... 400/618, 400/619, 611, 612, 613, 614
See application file for complete search history.

(56) References Cited

U.S. PATENT DOCUMENTS

| | | | | | |
|---|---|---|---|---|---|
| 4,577,199 | A * | 3/1986 | Saiki et al. | ..... | 347/215 |
| 5,371,521 | A * | 12/1994 | Wehrmann | ..... | 347/171 |
| 5,468,080 | A * | 11/1995 | Jones | ..... | 400/618 |
| 5,718,525 | A * | 2/1998 | Bruhnke et al. | ..... | 400/586 |
| 5,810,494 | A * | 9/1998 | Menard et al. | ..... | 400/634 |
| 5,820,280 | A * | 10/1998 | Fox | ..... | 400/611 |
| 6,601,951 | B2 * | 8/2003 | Kuwabara et al. | ..... | 347/101 |
| 6,910,820 | B2 * | 6/2005 | Baker et al. | ..... | 400/611 |
| 6,988,797 | B2 * | 1/2006 | Samii et al. | ..... | 347/106 |
| 2002/0005870 | A1 * | 1/2002 | Codos et al. | ..... | 347/9 |

* cited by examiner

*Primary Examiner*—Anthony H. Nguyen
(74) *Attorney, Agent, or Firm*—Jordan and Hamburg LLP

(57) ABSTRACT

A digital textile printer includes front and rear feeding devices driven by a transfer axil within a driving panel of the front and the rear of a base to prevent distortion and wrinkle phenomena generating defective printing to perform effectively the textile printing even to very thin textile fabrics, an ink-retrieving hole along to the transfer axil on the top of the base to collect the residues of the injected ink passing through a printing material to prevent ink from spreading at the printing material, at least one suction pan in the inside of the base to collect easily the residues of the injected ink to hasten dries of ink, and a heater of rubber material in the inside of the front of the base to hasten dries of the printing material passing through the ink-retrieving hole.

7 Claims, 7 Drawing Sheets

DIGITAL TEXTILE PRINTER

BACKGROUND OF THE INVENTION

The present invention relates to a digital textile printer, and more particularly a printer performing effectively not only general printing operations to a relatively thick printing material (textile fabrics or papers), such as a banner, an advertising material, or a photograph, but also textile printing operations to very thin printing material, such as textile fabrics.

Generally, in the conventional printer utilizing a technique of subtractive mixture, a digital controller sends digitalized signals to a head of the printer, so that the head may inject proper amounts of ink of three primary colors comprising magenta, yellow, and cyan, and of a black color to a printing material to produce various color tones. Therefore, the latest printer makes it possible for a user to design more easily what she/he wants.

In the technique of subtractive mixture, the head of the printer is equipped with several ink reservoirs, while each ink reservoir contains one color respectively. The head injects proper amounts of ink from each reservoir to produce a new color tone. The head is often further equipped with another ink reservoir containing special color to produce a new color tone, if necessary.

By referencing FIG. 1 and FIG. 2, the conventional digital printer will be described briefly in the following statements.

The conventional printer includes a transfer belt 5 with a rail shape on the top of a base 3, while the base 3 is supported by legs 1 contacting with the ground. The one side of a cartridge 9 is fixed with the transfer belt 5, so that a head 7 of the cartridge 9 can be moved via the transfer belt 5. In addition, a transfer axil 50 is connected with a transfer motor (not shown) within a driving panel 18 installed in the one side of the inner upper side of the base 3. Additionally, several transfer rollers 51 on the transfer axil 50 are extruded on the top of the base 3 to make a printing material 17 move to the forward direction, while a press roller 40 equipped correspondingly on the top of each transfer roller 51 presses the printing material 17 to the downward direction.

In addition, a feeding roller 11 installed in the rear side of the digital printer supplies the printing material 17 to the top of the base 3. When the cartridge 9 moves reciprocally to the left or the right direction on the top of the printing material 17, the head 7 moving in combination with the cartridge 9 injects predetermined amounts of each color from the corresponding ink reservoir to perform printing operations. As a result, the printed material is recoiled in a rewinding roller 12 located on the opposite side of the feeding roller 11.

An operation panel 16 covered by a cover 15 is equipped on the top of the base 3. Therefore, a user can input any desirable signal to be printed in the printing material 17.

In other words, as shown in FIG. 2, the printing material 17 is suspended to the feeding roller 11 in the rear of a fixing frame 10 between the legs 1, and the end of the printing material 17 passes through the top of the base 3 supported by the legs 1. In addition, the rewinding roller 12 winding the printing material 17 printed at the base 3 is in the front of the fixing frame 10.

However, the conventional printer described in the above statements has the following problems. After the printing material 17 is put between the several transfer rollers 51 and press rollers 40, the transfer roller 51 rotates to make the printing material 17 move to the front side of the base 3. When the printing material 17 is extremely thin, for example, in the case of textile printing, the speed of the printing material 17 passing through between the transfer rollers 51 and the press rollers 40 is different from that of the printing material 17 before the transfer roller 51. Therefore, a portion of the printing material 17 is often wrinkled, and the wrinkled moving printing material 17 has a tendency of inclining toward one direction only. As a result, when the printing material 17 is distorted or wrinkled, printing colors are overlapped resulting in a high fraction of defective results of the printing operations.

Additionally, the conventional digital printer does not have a feeding means drawing and rewinding the printing material 17 in constant speed to maintain the printing material 17 in a plane. Therefore, the distortion or the wrinkle of the printing material 17 is deepened more to increase the fraction of defective results of the printing operation.

SUMMARY OF THE INVENTION

To overcome the above described problems, the present invention provides a digital textile printer comprising the front rewinding and the rear feeding devices, at the front and the rear of the base, driven by a transfer axil in a driving panel, winding a printing material to a rewinding roller in a constant tension force, preventing defective printing operations generated by distorting or wrinkling phenomena of the printing material, and performing effective textile printing to the very thin textile fabrics eventually.

In addition, the present invention provides a digital textile printer comprising an elongated ink-retrieving hole, on the top of the base, collecting the residues of the injected ink passing through the printing material to prevent the printing material from ink contamination or ink smearing.

Additionally, the present invention provides a digital textile printer comprising a heater of rubber material, in the inside of the front of the base, drying promptly the printing material passing through the ink-retrieving hole.

To achieve the above described purpose, the present invention discloses a digital textile printer with a transfer belt having a rail shape on the top of the base supported by both legs contacted with the ground, a cartridge transferable through the transfer belt and fixing a head unit at the one side of the cartridge, a transfer axil with an elongated shape coupled with a transfer motor in a driving panel installed on the top of the inside of a base, multiple transfer rollers of the transfer axil protruding to the top of the base to make a printing material move to the forward direction, a feeding roller means installed in the rear of the base sending the printing material through the top of the base, a rewinding roller means rewinding the printing material from the top of the base, comprising: at least one rear guiding roller means at the rear of the base, coupled with the transfer axil; a rear feeding device including a rear tension means at the bottom of the rear of the legs to rotate eccentrically in a predetermined angle, a rear position sensor installed at a predetermined position of the rear tension means to correspond to a rear eccentric axil of the rear tension means winding the printing material, and a feeding motor installed on the top of the rear tension means to drive a rear bobbin axil of the feeding roller means combined with a rear bobbin feeding the printing material by receiving signals from the rear position sensor; at least one front guiding roller means at the front of the base, linked with the transfer axil; and a front rewinding device including a front tension means at the bottom of the front of the legs to rotate eccentrically in a predetermined angle, a front position sensor installed at a predetermined position of the front tension means to correspond to a front eccentric axil of the front tension means winding the printing material, and a rewinding motor installed on the top of the front tension means to drive a front bobbin axil of the rewinding roller means combined with a front bobbin rewinding the printing material by receiving signals from the front position sensor.

In addition, the front tension means installed at the front of the bottom of the legs, comprises: front fixtures facing each other at the front of two legs; a front rotation axil installed eccentrically between two front brackets with a predetermined length, penetrating two front brackets, and both ends of the front rotation axil combined with the front fixtures; and a front eccentric axil, corresponding to the printing material, apart in a predetermined distance from the front rotation axil between the two front brackets.

Additionally, the rear tension means installed at the rear of the bottom of the legs, comprises: rear fixtures facing each other at the rear of two legs; a rear rotation axil installed eccentrically between two rear brackets with a predetermined length, penetrating two rear brackets, and both ends of the rear rotation axil combined with the rear fixtures; and a rear eccentric axil, corresponding to the printing material, apart in a predetermined distance from the rear rotation axil between the two rear brackets.

Further, the front guiding roller means further comprises multiple front rollers coupled with the transfer belt of the transfer axil and combined with at least one front tension axil.

In addition, the rear guiding roller means further comprises multiple rear rollers coupled with the transfer belt of the transfer axil and combined with at least one rear tension axil.

Further, the diameter of the front roller of the front guiding roller means linked directly with the transfer axil is slightly larger than the diameter of the rear roller of the rear guiding roller means.

Additionally, the digital textile printer further comprises an ink-retrieving hole in an elongated shape on the top of the base to collect the residues of the injected ink passing though the printing material.

In addition, the digital textile printer further comprises a heater of rubber material at the inside of the base to dry promptly the printing material. In addition, the digital textile printer according to claim 1, further comprises: multiple front adjusting holes between the two front brackets; and a front tension adjusting axil installed in one of the multiple front adjusting holes to balance with the weight of the front eccentric axil, and eventually to adjust tension strength of the front eccentric axil.

Further, the digital textile printer according to claim 1, further comprises: multiple rear adjusting holes between the two rear brackets; and a tension rear adjusting axil installed in one of the multiple rear adjusting holes to balance with the weight of the rear eccentric axil, and eventually to adjust tension strength of the rear eccentric axil.

For a more complete understanding of the present invention and the advantages thereof, reference is now made to the following descriptions taken in conjunction with the accompanying drawings, in which like reference numerals denote like parts.

DETAILED DESCRIPTION OF THE INVENTION

Reference will now be made in detail to preferred embodiments of the present invention, example of which is illustrated in the accompanying drawings.

Figure 1:
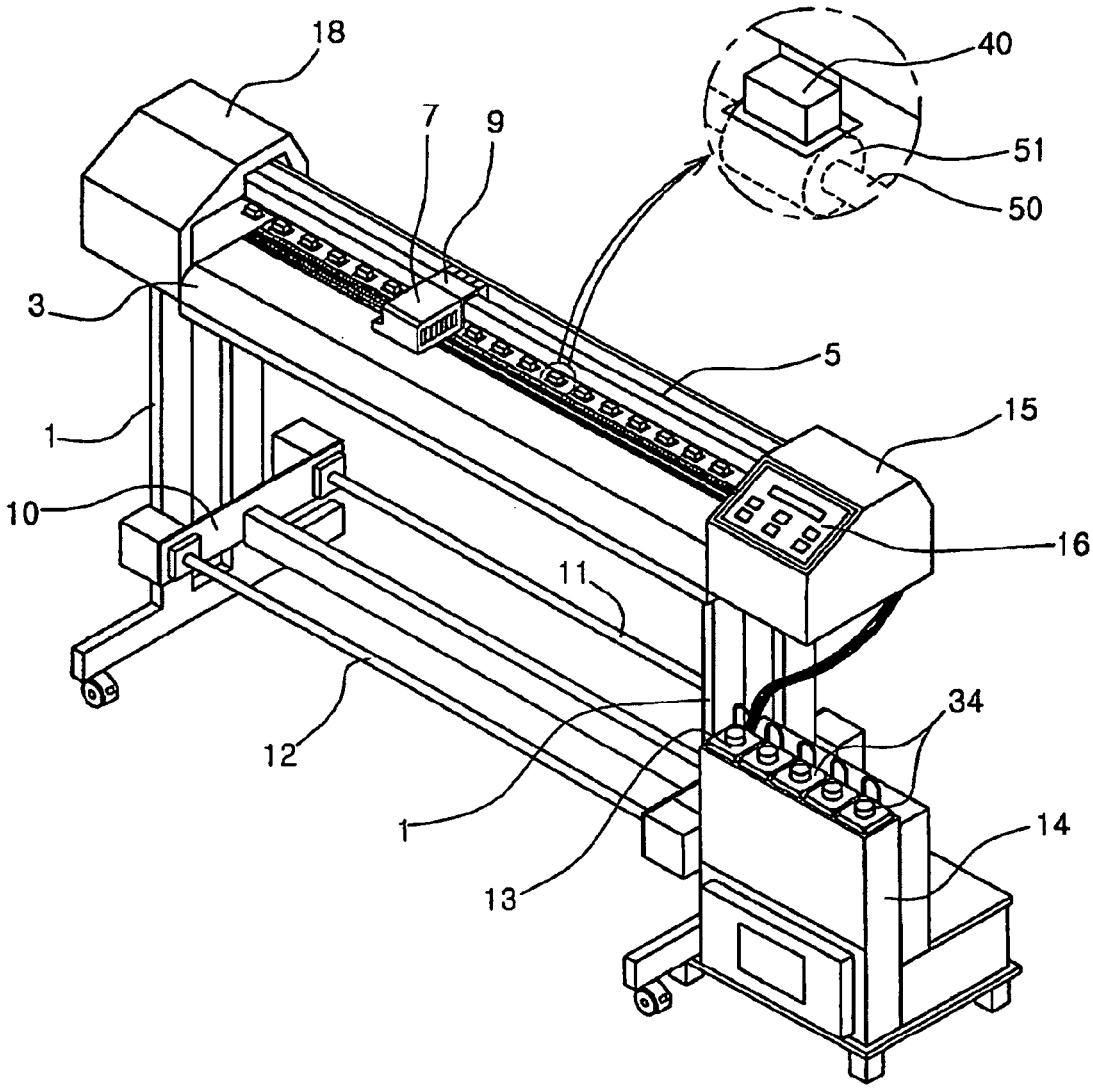
FIG. 1 PRIOR ART
FIG. 1 is a perspective view of the conventional printer.
Figure 2:
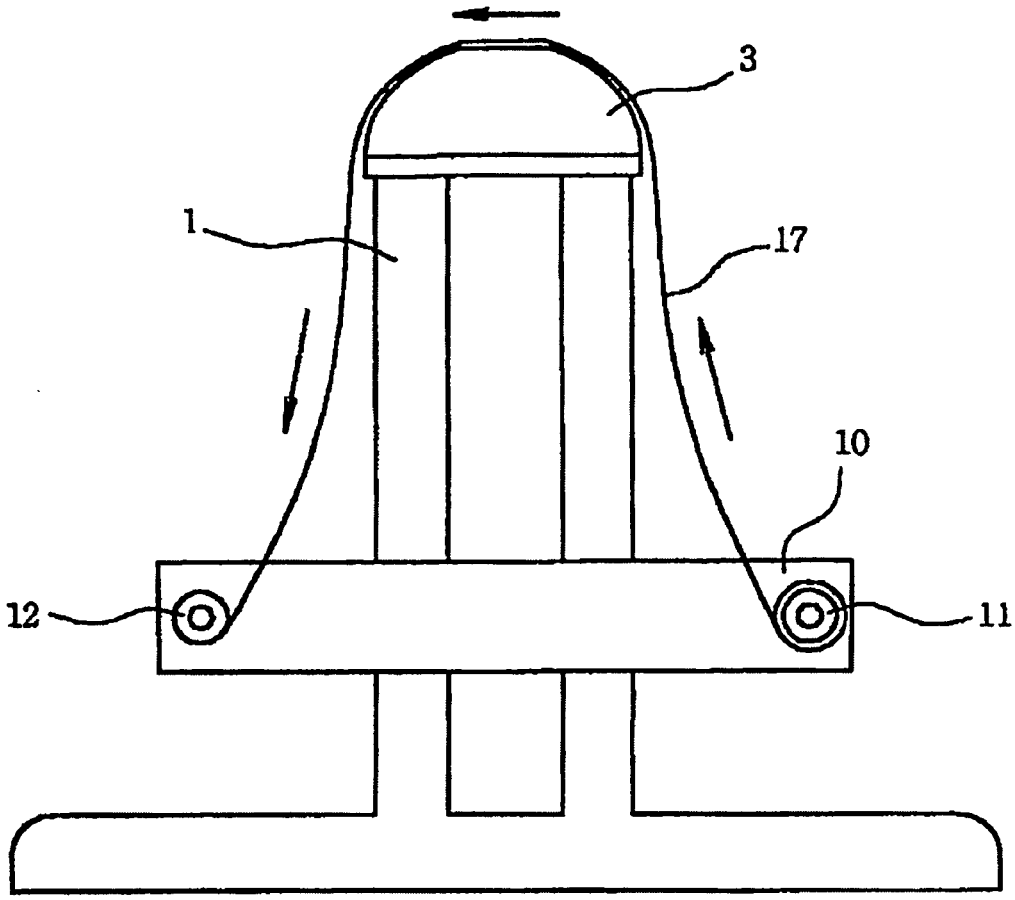
FIG. 2 PRIOR ART
FIG. 2 is a schematic view of the transferring states of a printing material of FIG. 1.
Figure 3:
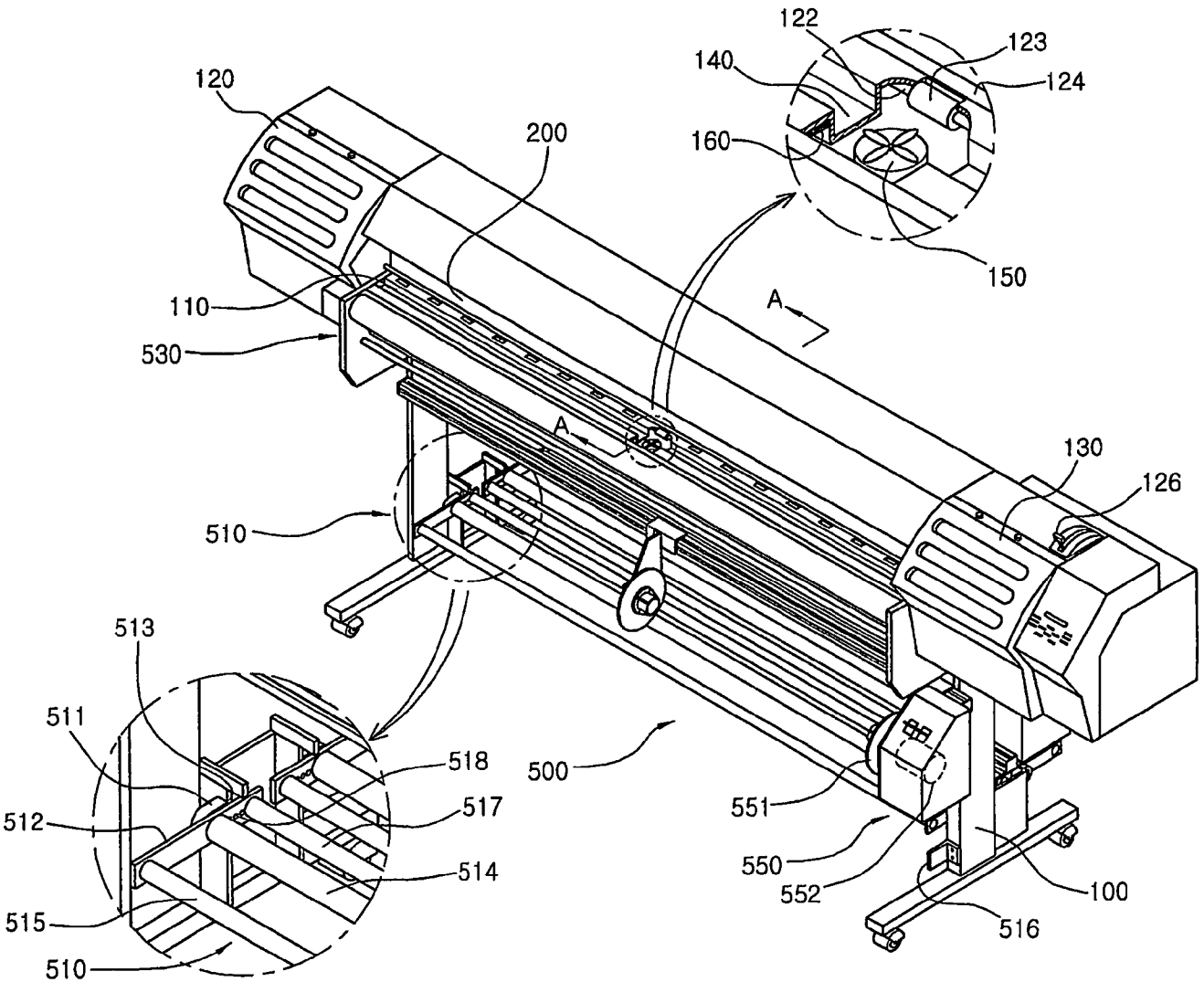
FIG. 3 is a perspective view of the front of a digital textile printer of the present invention.
Figure 5:
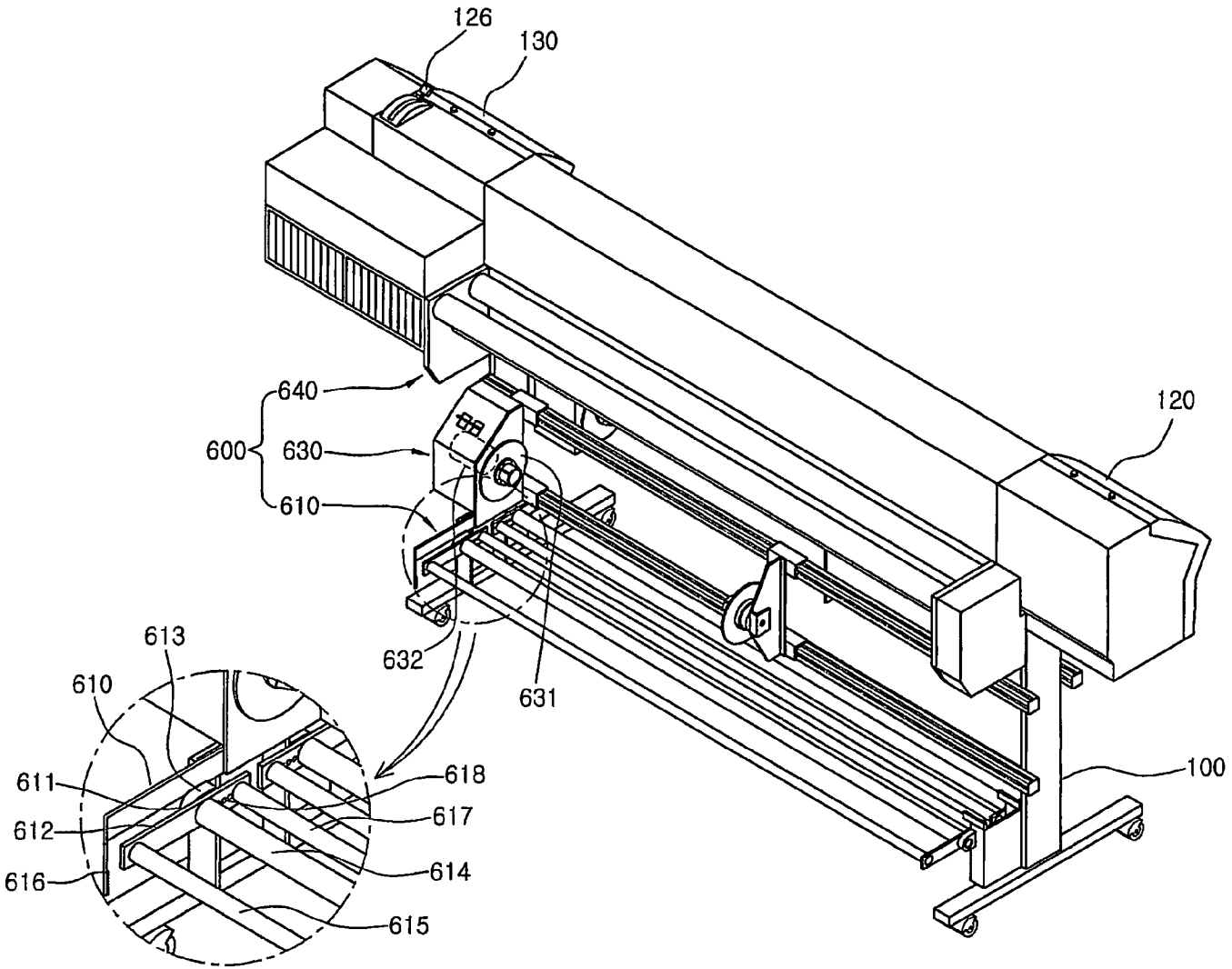
FIG. 5 is a perspective view of the rear of the digital textile printer of the present invention.

FIG. 3 is a perspective view of the front of a large sized printer, and FIG. 5 is a perspective view of the rear of the large sized printer according to the present invention.

A digital textile printer comprises a transfer belt 200 with a rail shape on the top of a base 110 supported by both legs 100 contacted with the ground. The transfer belt 200 is combined with a cartridge (not shown), while the cartridge is movable through the transfer belt and a head unit (not shown) is fixed with the one side of the cartridge.

Figure 6:
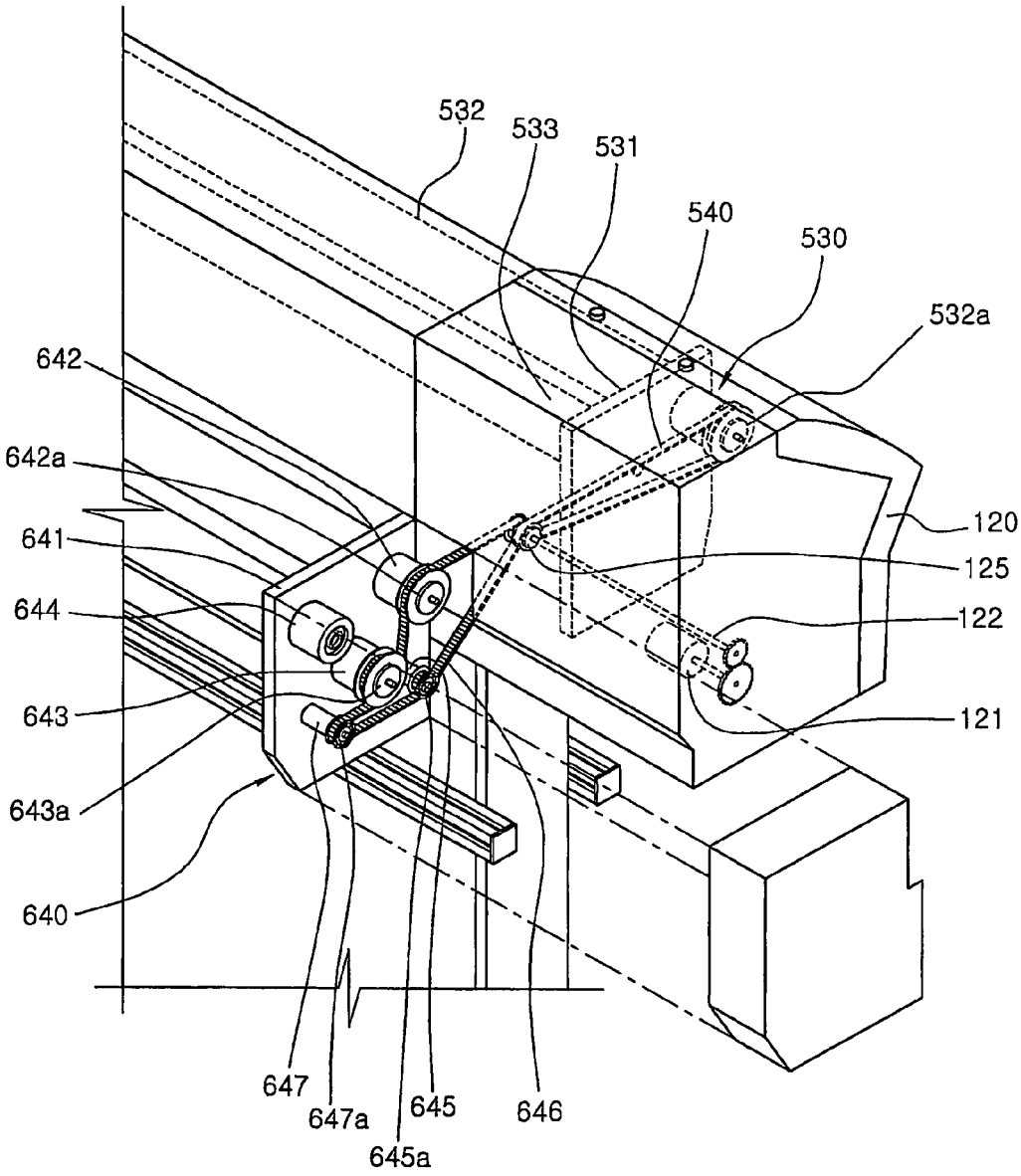
FIG. 6 is a perspective view of the main part of a guiding roller means of the present invention.

As shown in FIG. 6, a driving panel 120 at the top of the one side of the base 110 comprises a transfer motor 121 and a transfer axil 122. The transfer axil 122 is combined with a transfer motor 121, and installed in long direction within the base 110. As shown in FIG. 3, the transfer axil 122 includes multiple transfer rollers 123 protruding to the top of the base 110. A press rod 124 is on the top of the transfer roller 123, and each press rod 124 corresponds to each transfer roller 123 respectively to transfer a printing material 800 to the forward direction. A handle lever 126 comprised in an operation panel 130 drives the press rod 124.

As shown in FIG. 5, a rear feeding device 600 installed in the rear of the base 110 comprises a rear tension means 610, at the bottom of the rear of the leg 100, rotatable eccentrically in a predetermined angle. A rear position sensor 616 corresponding to a rear eccentric axil 615 winding the printing material 800 is installed in a predetermined position of the top of the tension means 610. A feeding roller means 630 on the top of the rear tension means 610 comprises a bobbin axil 631 coupled with a bobbin (not shown) winding the printing material 800, and a feeding motor 632 driven by signals from the rear position sensor 616.

The rear tension means 610 comprises rear fixtures 611 facing each other at the rear of both legs 100, two rear brackets 612 with a predetermined length, a bearing 613, a rotation axil 614, and a rear eccentric axil 615. While the rotation axil 614 is installed in eccentric between two rear brackets 612, the one end of the rotation axil 614 is connected with the rear fixture 611, and the other end of the rotation axil 614 is connected with the bearing 613. In addition, the rear eccentric axil 615 corresponding to the printing material 800 is between two rear brackets 612, and maintains a predetermined distance from the rotation axil 614.

Figure 7:
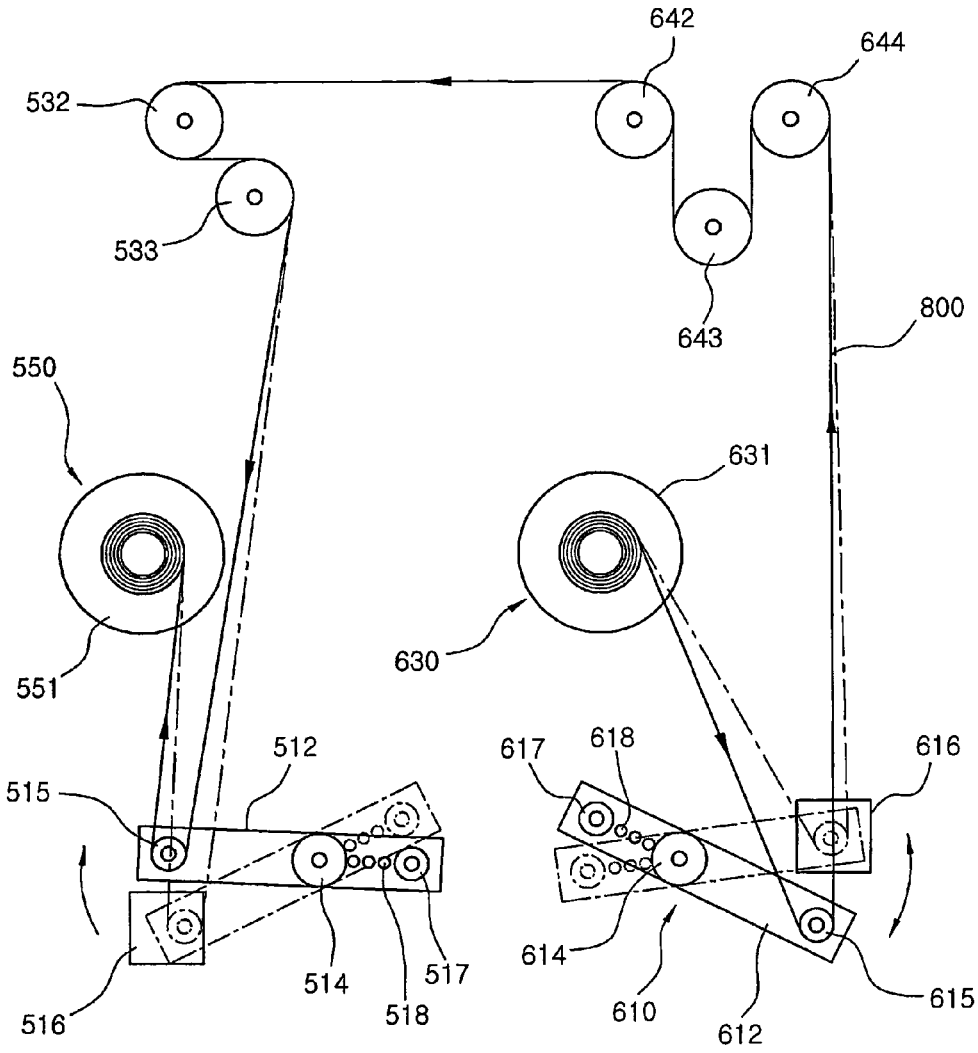
FIG. 7 is a schematic view describing the printing states of a printing material according to the present invention.

In other words, when the printing material 800 is wound to cause the rear bracket 612 to lift up to the direction of the arrow mark in FIG. 7, and the rear position sensor 616 detects the rear bracket 612 oriented like the dotted line in FIG. 7. Sequentially, the rear position sensor 616 receives signals to rotate the feeding motor 632, and supplies the printing material 800 in the bobbin coupled with the bobbin axil 631 to the forward direction. As a result, the rear eccentric axil 615 of the rear tension means 610 falls down to the downward direction like the solid line in FIG. 7.

In addition, multiple adjusting holes 618 are formed between two rear brackets 612, and a rear tension adjusting axil 617 installed in one of the multiple adjusting holes 618 is controlled to be balanced with the weight of the rear eccentric axil 615, and eventually to adjust tension strength of the rear eccentric axil 615.

As shown in FIG. 5 and FIG. 6, a rear guiding roller means 640 linked with the transfer axil 122 and installed in the rear of the base 110, comprises a first roller 642, a second roller 643, and a third roller 644 in two brackets 641 of both sides of the base 110 in adjacent and in a predetermined height difference. In addition, pulleys 642*a* and 643*a* of the first and the second rollers 642 and 643 are coupled with a pulley 125 of the transfer axil 122 by means of a belt 646. Pulleys 645*a* and 647*a* of two tension axils 645 and 647 installed in a bracket 641 are connected with the belt 646, and make the belt 646 maintain constant tension force always.

As described in the above statements, the existing transfer axil 122 is used to drive the rear feeding device 600. Therefore, it is possible to embody a simple structure of the printing machine and to lower raw costs of manufacturing the printing machine.

As shown in FIG. 3, a front rewinding device 500 installed in the front of the base 110 comprises a front tension means 510, at the bottom of the front of the leg 100, rotatable eccentrically in a predetermined angle. A front position sensor 516 corresponding to a front eccentric axil 515 winding the printing material 800 is installed in a predetermined position of the top of the front tension means 510. A rewinding roller means 550 on the top of the front tension means 510 comprises a bobbin axil 551 coupled with a bobbin (not shown) winding the printing material 800, and a rewinding motor 552 driven by signals from the front position sensor 516.

The front tension means 510 comprises front fixtures 511 facing each other at the front of both legs 100, two front brackets 512 with a predetermined length, a bearing 513, a rotation axil 514, and a front eccentric axil 515. While the rotation axil 514 is installed in eccentric between two front brackets 512, the one end of the rotation axil 514 is connected with the front fixture 511, and the other end of the rotation axil 514 is connected with the bearing 513. In addition, the front eccentric axil 515 corresponding to the printing material 800 is between two front brackets 512, and maintains a predetermined distance from the rotation axil 514.

In addition, multiple adjusting holes 518 are formed between two front brackets 512, and a front tension adjusting axil 517 installed in one of the multiple adjusting holes 518 is controlled to be balanced with the weight of the front eccentric axil 515, and eventually to adjust tension strength of the front eccentric axil 515.

As shown in FIG. 3 and FIG. 6, a front guiding roller means 530 linked with the transfer axil 122 and installed in the front of the base 110, comprises a first roller 532 and a second roller 533 in two brackets 531 of both sides of the base 110 in adjacent and in a predetermined height difference. In addition, a pulley 532*a* of the first roller 532 is coupled with the pulley 125 of the transfer axil 122 by means of a belt 540. In other words, the existing transfer axil 122 is used to drive the front rewinding device 500 without extra driving means. Therefore, it is possible not only to embody a simple structure of the printing machine, but also to maintain high accuracy.

As shown in FIG. 7, because of loads of the front eccentric axil 515 of the front tension means 510 and of the rear eccentric axil 615 of the rear tension means 610, the printing material 800 between them is tightened. Therefore, distortion or wrinkle of the printing material 800 is prevented. In addition, the diameter of the first roller 532 of the front guiding roller means 530 is slightly larger than that of the first roller 642 of the rear guiding roller means 640. Therefore, the printing material 800 is pulled out to the front direction by constant force.

Figure 4:
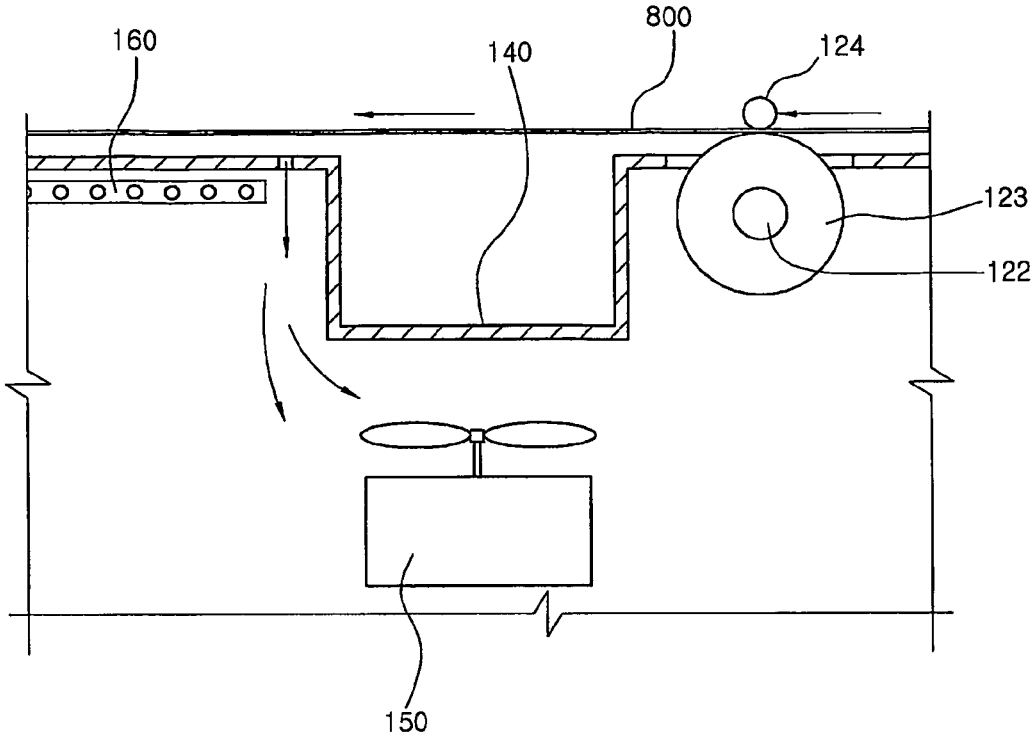
FIG. 4 is a cross sectional view of the main part of the digital textile printer through the line A-A according to the present invention.

As shown in FIG. 3, it is preferable to form an elongated ink-retrieving hole 140 on the top of the base 110 to collect the residues of the injected ink passing through the printing material 800. As shown in FIG. 4, it is preferable to form at least one suction pan 150 in the inside of the base to collect easily the residues of the injected ink passing through the printing material 800, and to form a heater 160 of rubber material at the bottom of the base 110 to dry promptly the printing material 800 passing through the ink-retrieving hole 140.

Operations of the digital textile printing machine of the present invention will be described in the following statements.

To install the printing material 800 to the digital textile printing machine, the printing material 800 is pulled out from the bobbin combined with the bobbin axil 631 of the feeding roller means 630 at first, as shown in FIG. 5. Sequentially, the edge of the printing material 800 passes though the rear eccentric axil 615 of the rear tension mean 610, the third roller 644, the second roller 643, the first roller 642, the base 110, the first roller 532, the second roller 533, the front eccentric axil 515, and finally the bobbin axil 551 of the rewinding roller means 550, as shown in FIG. 7.

When the digital textile printing machine is operated, the transfer axil 122 linked with the transfer motor 121 in the driving panel 120 becomes to rotate, and the transfer roller 123 of the transfer axil 122 makes the printing material 800 move to the forward direction. Simultaneously, the first rollers 532 and 642 and the second roller 643 of the front and the rear guiding roller means 530 and 640 linked with the transfer axil 122 also rotate to make the printing material 800 move to the forward direction.

Meanwhile, the rewinding motor 552 of the rewinding roller means 550 rotates to wind the printing material to the bobbin like shown by the solid line in FIG. 7. At this moment, the rotation of the rewinding motor 552 lifts up the bracket 512 including the front eccentric axil 515. Simultaneously, when the bracket 512 reaches to the position of the front position sensor 516, signals are sent to the front position sensor 516 to suspend rotation of the rewinding motor 552.

As shown in FIG. 7, because of loads of the front eccentric axil 515 of the front tension means 510 and of the rear eccentric axil 615 of the rear tension means 610, the printing material 800 between them is tightened. Therefore, distortion or wrinkle of the printing material 800 is prevented. In addition, the diameter of the first roller 532 of the front guiding roller means 530 is slightly larger than that of the first roller 642 of the rear guiding roller means 640. Therefore, the printing material 800 is pulled out to the front direction by constant force.

In addition, when the printing material 800 is wound to make the rear bracket 612 lifted up to the direction of the arrow mark in FIG. 7, and the rear position sensor 616 detects the rear bracket 612 as oriented like the dotted line in FIG. 7. Sequentially, the rear position sensor 616 receives signals to rotate the feeding motor 632, and supplies the printing material 800 in the bobbin coupled with the bobbin axil 631 to the forward direction. As a result, the rear eccentric axil 615 of the rear tension means 610 falls down to the downward direction like shown by the solid line in FIG. 7.

In other words, the rewinding motor 552 winds the printing material 800 only when the front position sensor 516 sends signals to the rewinding motor 552. In addition, the feeding motor 632 supplies the printing material 800 only when the rear position sensor 616 sends signals to the feeding motor 632. Such processes are repeated over and over again.

The ink-retrieving hole 140 is formed on the top of the base 110 to collect effectively the residues of the injected ink passing through the printing material 800 to prevent ink from spreading, as shown in FIG. 3, and the suction pan 150 in the inside of the base 110 collects easily the residues of the injected ink passing though the printing material 800, as shown in FIG. 4. In addition, the heater 160 in the inside of the front of the base 110 dries promptly the printing material 800 simultaneously.

As described in the above statements, the digital textile printing machine of the present invention comprises the front rewinding and the rear feeding devices 500 and 600 driven by the transfer axil 122 within the driving panels of the front and the rear of the base 110. Therefore, the printing material 800 is wound on a roller in the states of constant tension forces to prevent distortion and wrinkle phenomena generating defective printing. As a result, it is possible to perform effectively the textile printing even to the very thin textile fabrics.

Additionally, the digital textile printing machine of the present invention comprises an elongated ink-retrieving hole 140 along to the transfer axil 122 on the top of the base 110 to collect the residues of the injected ink passing through the printing material 800 to prevent ink from spreading at the printing material 800.

In addition, the digital textile printing machine of the present invention comprises at least one suction pan 150 in the inside of the base 110 to collect easily the residues of the injected ink to hasten dries of ink.

Additionally, the digital textile printing machine of the present invention comprises the heater 160 of rubber material in the inside of the front of the base 110 to hasten dries of the printing material 800 passing through the ink-retrieving hole.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A digital textile printer, comprising:

a base supported by legs on the ground;

a transfer belt being disposed on the base;

a cartridge being transferable via the transfer belt;

a head unit being fixed at one side of the cartridge;

a driving panel being installed on the top of the base;

a transfer motor being housed in said driving panel;

a transfer axil having an elongated shape being coupled with said transfer motor;

transfer rollers being disposed on the transfer axil, said transfer rollers protruding to a top of the base for moving a printing material in a forward direction;

a feeding roller mechanism being installed in a rear of the base, said feeding roller mechanism being operable to send the printing material through the top of the base, said feeding roller mechanism including a rear bobbin axil;

a rewinding roller mechanism operable for rewinding the printing material from the top of the base;

at least one rear guiding roller mechanism being disposed at the rear of the base, said at least one rear guiding roller mechanism being coupled with the transfer axil;

a rear feeding device including a rear tension mechanism which is disposed at a bottom of the rear of the legs operable to rotate eccentrically in a predetermined angle, a rear position sensor installed at a predetermined position of the rear tension mechanism to correspond to a rear eccentric axis of the rear tension mechanism winding the printing material, and a feeding motor installed on the top of the rear tension mechanism operable to drive said rear bobbin axil combined with a rear bobbin operable to feed the printing material by receiving signals from the rear position sensor;

at least one front guiding roller mechanism being disposed at the front of the base, linked with the transfer axil; and a front rewinding device including a front tension mechanism which is disposed at the bottom of the front of the legs operable to rotate eccentrically in a predetermined angle, a front position sensor installed at a predetermined position of the front tension mechanism to correspond to a front eccentric axis of the front tension mechanism winding the printing material, and a rewinding motor installed on the top of the front tension mechanism to drive a front bobbin axis of the rewinding roller mechanism combined with a front bobbin rewinding the printing material by receiving signals from the front position sensor.

2. The digital textile printer according to claim 1, wherein the front/rear tension mechanism installed at the front/rear of the bottom of the legs, comprises:

front/rear fixtures facing each other at the front of the legs;

a front/rear rotation axil installed eccentrically between two front/rear brackets with a predetermined length, penetrating two front/rear brackets, and both ends of the front/rear rotation axil combined with the front/rear fixtures; and a front/rear eccentric axil, corresponding to the printing material, apart in a predetermined distance from the front/rear rotation axil between the two front/rear brackets.

3. The digital textile printer according to claim 1, wherein the front/rear guiding roller mechanisms each further comprises multiple front/rear rollers coupled with the transfer belt of the transfer axil and combined with at least one front/rear tension axil.

4. A digital textile printer, comprising:

a base;

legs contacted with the ground which support said base;

a transfer belt having a rail shape being disposed on a top of the base;

a cartridge being transferable via the transfer belt;

a head unit being fixed at a side of the cartridge;

a driving panel being installed on the top of the base;

a transfer motor being housed in said driving panel;

a transfer axil having an elongated shape being coupled with said transfer motor;

multiple transfer rollers being disposed on the transfer axil, said transfer rollers protruding to the top of the base to make a printing material move to a forward direction;

a feeding roller mechanism being installed in a rear of the base, said feeding roller mechanism being operable to send the printing material through the top of the base, said feeding roller mechanism including a rear bobbin axil;

a rewinding roller mechanism operable for rewinding the printing material from the top of the base;

at least one rear guiding roller mechanism being disposed at the rear of the base, said at least one rear guiding roller mechanism being coupled with the transfer axil;

a rear feeding device including a rear tension mechanism which is disposed at a bottom of the rear of the legs operable to rotate eccentrically in a predetermined angle, a rear position sensor installed at a predetermined position of the rear tension mechanism to correspond to a rear eccentric axis of the rear tension mechanism winding the printing material, and a feeding motor installed on the top of the rear tension mechanism operable to drive said rear bobbin axil combined with a rear bobbin operable to feed the printing material by receiving signals from the rear position sensor;

at least one front guiding roller mechanism being disposed at the front of the base, linked with the transfer axil; and a front rewinding device including a front tension mechanism which is disposed at the bottom of the front of the legs operable to rotate eccentrically in a predetermined angle, a front position sensor installed at a predetermined position of the front tension mechanism to correspond to a front eccentric axis of the front tension mechanism winding the printing material, and a rewinding motor installed on the top of the front tension mechanism to drive a front bobbin axis of the rewinding roller mechanism combined with a front bobbin rewinding the printing material by receiving signals from the front position sensor wherein a diameter of the front roller of the front guiding roller mechanism linked directly with the transfer axil is slightly larger than a corresponding diameter of the rear roller of the rear guiding roller mechanism.

5. A digital textile printer, comprising:

a base;

legs contacted with the ground which support said base;

a transfer belt having a rail shape being disposed on a top of the base;

a cartridge being transferable via the transfer belt;

a head unit being fixed at a side of the cartridge;

a driving panel being installed on the top of the base;

a transfer motor being housed in said driving panel;

a transfer axil having an elongated shape being coupled with said transfer motor;

multiple transfer rollers being disposed on the transfer axil, said transfer rollers protruding to the top of the base to make a printing material move to a forward direction;

a feeding roller mechanism being installed in a rear of the base, said feeding roller mechanism being operable to send the printing material through the top of the base, said feeding roller mechanism including a rear bobbin axil;

a rewinding roller mechanism operable for rewinding the printing material from the top of the base;

at least one rear guiding roller mechanism being disposed at the rear of the base, said at least one rear guiding roller mechanism being coupled with the transfer axil;

a rear feeding device including a rear tension mechanism which is disposed at a bottom of the rear of the legs operable to rotate eccentrically in a predetermined angle, a rear position sensor installed at a predetermined position of the rear tension mechanism to correspond to a rear eccentric axis of the rear tension mechanism winding the printing material, and a feeding motor installed on the top of the rear tension mechanism operable to drive said rear bobbin axil combined with a rear bobbin operable to feed the printing material by receiving signals from the rear position sensor;

at least one front guiding roller mechanism being disposed at the front of the base, linked with the transfer axil;

a front rewinding device including a front tension mechanism which is disposed at the bottom of the front of the legs operable to rotate eccentrically in a predetermined angle, a front position sensor installed at a predetermined position of the front tension mechanism to correspond to a front eccentric axis of the front tension mechanism winding the printing material, and a rewinding motor installed on the top of the front tension mechanism to drive a front bobbin axis of the rewinding roller mechanism combined with a front bobbin rewinding the printing material by receiving signals from the front position sensor; and an ink-retrieving hole having an elongated shape being disposed on the top of the base to collect residues of injected ink passing though the printing material.

6. The digital textile printer according to claim 1, further comprising a heater of rubber material being disposed inside of the base to dry promptly the printing material.

7. The digital textile printer, comprising:

a base;

legs contacted with the ground which support said base;

a transfer belt having a rail shape being disposed on a top of the base;

a cartridge being transferable via the transfer belt;

a head unit being fixed at a side of the cartridge;

a driving panel being installed on the top of the base;

a transfer motor being housed in said driving panel;

a transfer axil having an elongated shape being coupled with said transfer motor;

multiple transfer rollers being disposed on the transfer axil, said transfer rollers protruding to the top of the base to make a printing material move to a forward direction;

a feeding roller mechanism being installed in a rear of the base, said feeding roller mechanism being operable to send the printing material through the top of the base, said feeding roller mechanism including a rear bobbin axil;

a rewinding roller mechanism operable for rewinding the printing material from the top of the base;

at least one rear guiding roller mechanism being disposed at the rear of the base, said at least one rear guiding roller mechanism being coupled with the transfer axil;

a rear feeding device including a rear tension mechanism which is disposed at a bottom of the rear of the legs operable to rotate eccentrically in a predetermined angle, a rear position sensor installed at a predetermined position of the rear tension mechanism to correspond to a rear eccentric axis of the rear tension mechanism winding the printing material, and a feeding motor installed on the top of the rear tension mechanism operable to drive said rear bobbin axil combined with a rear bobbin operable to feed the printing material by receiving signals from the rear position sensor;

at least one front guiding roller mechanism being disposed at the front of the base, linked with the transfer axil;

a front rewinding device including a front tension mechanism which is disposed at the bottom of the front of the legs operable to rotate eccentrically in a predetermined angle, a front position sensor installed at a predetermined position of the front tension mechanism to correspond to a front eccentric axis of the front tension mechanism winding the printing material, and a rewinding motor installed on the top of the front tension mechanism to drive a front bobbin axis of the rewinding roller mechanism combined with a front bobbin rewinding the printing material by receiving signals from the front position sensor;

a front/rear rotation axil installed eccentrically between two front/rear brackets with a predetermined length, penetrating two front/rear brackets, and both ends of the front/rear rotation axil combined with the front/rear fixtures;

multiple front/rear adjusting holes between the two front/rear brackets; and a front/rear tension adjusting axil being installed in one of the multiple front/rear adjusting holes to balance with a weight of the front/rear eccentric axil, and to adjust a tension strength of the front/rear eccentric axil.

* * * * *